United States Patent [19]

Anderson

[11] 3,951,269

[45] Apr. 20, 1976

[54] SELF-MOUNTING SUPPORT ROD

[75] Inventor: Robert V. Anderson, Fort Worth, Tex.

[73] Assignee: Producers Specialty and Mfg. Co., Inc., Fort Worth, Tex.

[22] Filed: Feb. 28, 1975

[21] Appl. No.: 554,068

Related U.S. Application Data

[63] Continuation of Ser. No. 436,136, Jan. 24, 1974, abandoned.

[52] U.S. Cl. ..... 211/105.4

[51] Int. Cl.[2] ..... B66C 21/00

[58] Field of Search..... 211/105.1, 105.2, 105.3, 211/105.4, 105.5, 105.6, 123, 124, 180; 248/57, 264, 268, 356; 285/46

[56] References Cited

UNITED STATES PATENTS

| | | | |
|---|---|---|---|
| 961,352 | 6/1910 | Walters | 248/356 X |
| 1,613,800 | 1/1927 | Lehnert | 248/264 |
| 1,837,340 | 12/1931 | Schwartz | 211/105.4 |
| 1,962,915 | 6/1934 | Sharp | 285/46 X |
| 2,275,236 | 3/1942 | Shannon | 211/105.4 X |
| 2,974,806 | 3/1961 | Seewack | 211/123 |
| 3,040,902 | 6/1962 | Dunn | 211/105.4 |

FOREIGN PATENTS OR APPLICATIONS

| | | | |
|---|---|---|---|
| 319,128 | 9/1929 | United Kingdom | 248/264 |

OTHER PUBLICATIONS

S30325 X/34f, German Printed Application of De Silva et al., published 6/1956.

*Primary Examiner*—William H. Schultz
*Attorney, Agent, or Firm*—Schmidt, Johnson, Hovey & Williams

[57] ABSTRACT

A support rod assembly may be mounted between a pair of opposed, spaced-apart surfaces without the use of mounting brackets, screws, nails, or other fasteners by manually rotating the rod relative to a threaded cap at one end of the rod so as to progressively extend the rod from the cap and wedge the assembly tightly between the opposed surfaces in pressure-mounted relationship therewith. The end caps of the assembly are each provided with a spike projecting in coaxial relationship with the rod for penetrating the surfaces during installation, thereby presenting fixed pivot points for the end caps should they tend to rotate with the rod during installation, to the end that "walking" of the rod out of position along the surfaces is eliminated. Components of the assembly are adapted to universally accommodate rods of more than one particular diameter.

2 Claims, 6 Drawing Figures

Fig. 1.
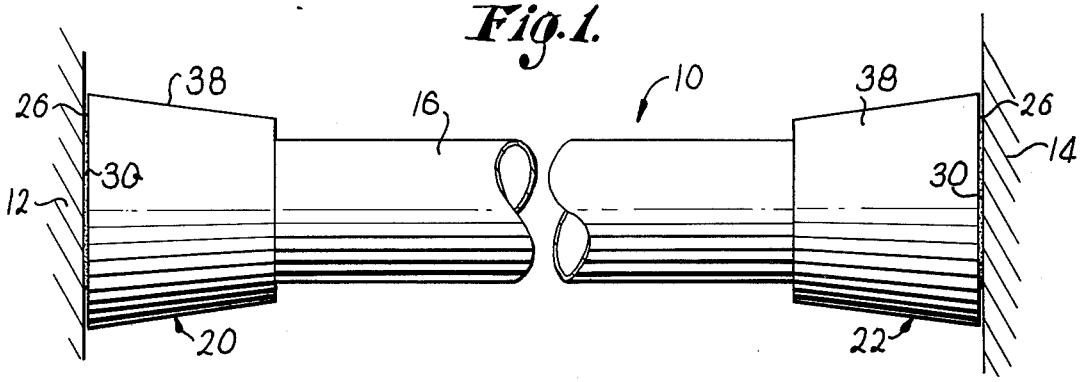
Fig. 2.
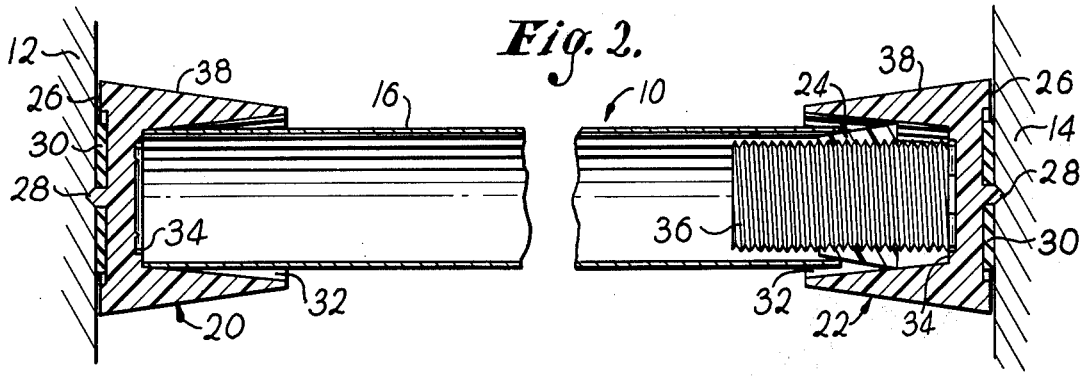
Fig. 3.
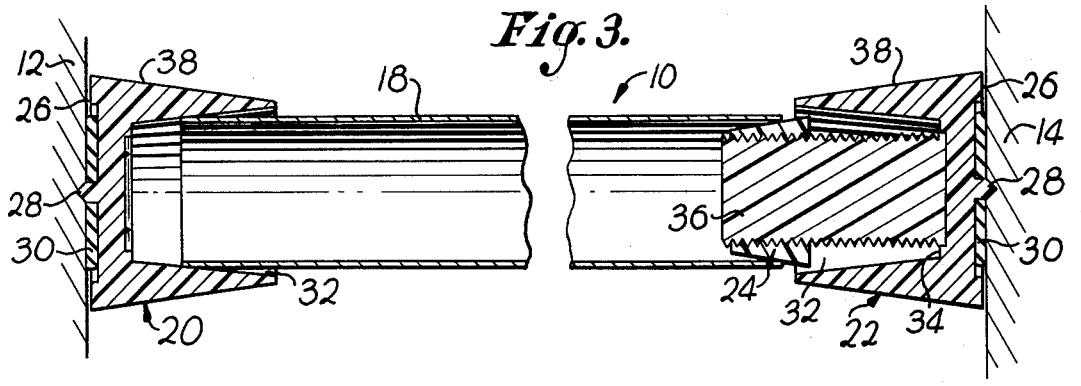
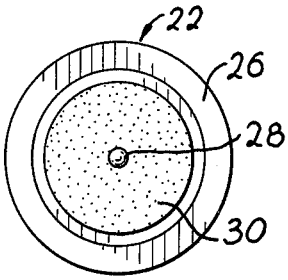
Fig. 5.
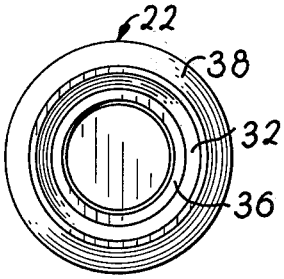
Fig. 6.
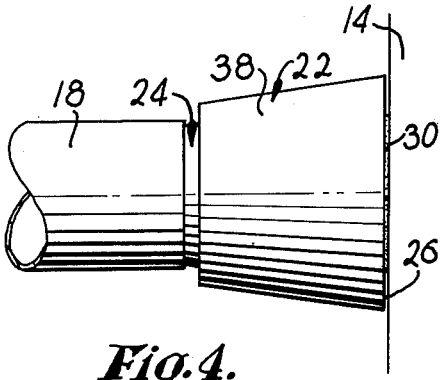
Fig. 4.

SELF-MOUNTING SUPPORT ROD

This is a continuation, of application Ser. No. 436,136 filed on Jan. 24, 1974, now abandoned.

This invention relates to a support rod assembly such as for use in supporting a shower curtain where a pair of upright, opposed walls are normally presented in the shower area. More particularly, this invention relates to a rod assembly that is self-mounting, i.e., requires no external fasteners or brackets of any kind in order to securely retain the same in its selected position.

One important object therefore of the present invention is to provide a support rod assembly that can be quite readily installed without requiring the use of a number of hand-tools and without requiring an abundance of skill and dexterity on the part of the individual installing the same.

A further important object of this invention is to provide a self-mounting support rod assembly as aforesaid which, once installed, is fully capable of carrying the loads normally placed thereon without becoming dislodged from its mounting surfaces.

Another important object of this invention is to provide an arrangement wherein rotation of the long rod of the assembly during installation affects extension of the assembly so as to wedge the same tightly between a pair of opposed surfaces, thereby permitting a distinct mechanical advantage to be obtained by virtue of the torsional force induced in the rod, hence creating an extremely tight wedging action without requiring the use of hand-tools.

An additional important object of the invention is the provision of a rod assembly that is pressure-mounted as aforesaid wherein the tendency for the assembly to "walk" along the opposed mounting surfaces during installation is eliminated by virtue of the tight wedging action created in conjunction with a set of locating and retaining spikes at opposite ends of the assembly which penetrate the opposed surfaces.

A still further important object of the invention is to provide an assembly so designed that its various parts can be readily grasped for holding the same by hand during the installation procedure whereby to acquire the relative rotation between such parts that is necessary to extend the assembly.

In addition, an important object of this invention is to provide an assembly which can accommodate more than one size of supporting rod without requiring changes or adaptations of any kind.

In the drawing:

FIG. 1 is an elevational view of the assembly instal between a pair of opposed surfaces;

FIG. 2 is a longitudinal cross-sectional view thereof;

FIG. 3 is a longitudinal cross-sectional view of the assembly employing a rod having a larger diameter than the one illustrated in FIGS. 1 and 2;

FIG. 4 is a fragmentary, elevational view of an end portion of the assembly with the larger rod utilized;

FIG. 5 is an end view of one of the holding caps of the assembly; and

FIG. 6 is a view of the opposite end of the threaded holding cap.

It is to be emphasized at the outset that the frequent use hereinabove and hereinafter of the term "rod" in connection with the support assembly is not intended to be taken in a limiting sense. As will be apparent, whether the carrier member of the assembly is tubular or is solid with a cavity on at least one end is of no particular concern. The term rod has been selected because of its common usage in this particular field and is intended to be broadly applied.

The rod assembly 10 is adapted to be pressure-mounted between a pair of opposed surfaces such as walls 12 and 14 without the use of screws or other fasteners. As will hereinafter become apparent, the carrier rod member which forms a part of assembly 10 may be of many different sizes, one of which is embodied by way of example in the rod 16 of FIGS. 1 and 2, and another of which is embodied in the larger rod 18 of FIGS. 3 and 4. The remainder of the assembly 10 consists of a pair of special holding caps 20 and 22 which are disposed at opposite ends of the rod 16 or 18 for disposition against the walls 12 and 14, and an adapter component 24 associated with cap 22 that not only renders assembly 10 able to accept the rod 16, 18 or others, but also forms a key part in the structure which allows the assembly 10 to be extended.

Each end cap 20 and 22 has an outer exposed face 26 that lies against the wall 12 or 14 during installation, and is provided with a relatively short spike 28 penetrating its respective wall 12 or 14. The spikes 28 are coaxial with the rod 16 or 18, depending upon which is used, and friction-increasing means in the nature of a resilient, preferably rubber pad 30 surrounds each spike 28 for compression against the surfaces of walls 12 and 14 when assembly 10 is installed.

Each cap 20 and 22 has an exposed, frustoconical cavity 32 that progressively decreases in transverse dimension as the floor 34 of cavity 32 is approached. The cap 22 differs from cap 20 in that an externally threaded arbor 36 is disposed within cavity 32 of cap 22 in concentric relationship therewith. The arbor 36 is fixed to the floor 34 of cavity 32, is smaller in diameter than cavity 32 at its junction with floor 34, and projects outwardly therefrom for a distance to threadably receive the internally threaded, annular component 24. The component 24 may be made in two parts if necessary or desirable and is frustoconical in configuration. The large end of component 24 is smaller in diameter than the mouth of cavity 32 and yet is larger in diameter than cavity 32 at floor 34 such that component 24 can enter cavity 32 only part way before engaging the sides of cavity 32. With this arrangement component 24 can be rotated on arbor 36 and shifted axially within cavity 32 without binding until reaching its inner limit as shown in FIG. 2.

The component 24 is force-fit into one end of the rod 16 or 18 so that no relative rotation can occur between component 24 and its rod. In this manner the selected rod and its component 24 rotate as a unit about arbor 36 and move axially therealong into or out of cavity 32 depending upon the direction of rotation.

By virtue of the tapered configuration of component 24, the carrier rod selected may vary in diameter from the smallest diameter of component 24 (rod 16) to the largest diameter of component 24 (slightly larger than rod 18). Component 24 simply protrudes into the selected rod until the sides of component 24 come into tight, essentially line engagement with the wall of the rod.

Initially, all parts of assembly 10 are separate from one another. Assuming for purposes of illustration that the rod 16 is to be installed instead of the larger rod 18, the rod 16 is cut approximately to the necessary length, which is only slightly less than the distance between walls 12 and 14. One end of rod 16 is inserted into the cap 20 where it will abut the floor 34 thereof as illustrated in FIG. 2. The small end of component 24 is forced into the opposite open end of rod 16 until component 24 tightens within rod 16. Then the arbor 36 of cap 22 is threaded into component 24 until the large end of the latter engages the interior sidewall of cap 22.

Thereupon the assembly 10 is positioned at the desired height between walls 12 and 14 with the spike 28 of cap 20 engaging wall 12. Grasping the rod 16 with one hand, the cap 22 may then be rotated in the appropriate direction with the other hand to bring its spike 28 into engagement with wall 14. Such rotation of cap 22 may continue until spike 28 begins to embed in wall 14 and the pad 30 starts to compress.

As assembly 10 begins to tighten between walls 12 and 14 by virtue of the relative extension of cap 22 and rod 16, rotation of cap 22 may be terminated and rotation of the rod 16 begun. Such action is especially beneficial as assembly 10 gets progressively tighter and tighter because relative rotation of rod 16 and cap 22 becomes increasingly more difficult. Thus, by grasping rod 16 and rotating it instead of the shorter cap 22, a significant mechanical advantage can be obtained for tightening assembly 10 to a greater extent and with less effort than would otherwise be the case. By applying a rotational force to the rod 16 at a point spaced from the threaded connection between component 24 and arbor 36, a significantly increased torsional force is applied to the component 24 whereby to continue rotation thereof on arbor 36 even when resistance to such rotation is increased by virtue of the reactionary forces directed longitudinally of rod 16 by walls 12 and 14.

As the spikes 28 become progressively embedded into walls 12 and 14 during rotation of rod 16, the pads 30 become progressively compressed so as to help retain the end caps 20 and 22 against rotation with rod 16. Should it be necessary however to hold either of the caps 20 and 22, such is readily accommodated because of the relatively long exteriors 38 presented thereon. The length of such exteriors 38, plus the absence of numerous curvatures thereon, present handle-like structures to facilitate manual gripping of caps 20 and 22 should such become necessary or desirable.

Also of substantial significance is the fact that the spikes 28, by being coaxially disposed with respect to rod 16, preclude any "walking" action of such caps 20 and 22 along walls 12 and 14 during rotation of rod 16. Thus, should cap 20 tend to rotate with rod 16 during the time that the latter and cap 22 are being relatively rotated, the cap 20 cannot be displaced or "walked" laterally out of its initial position because cap 22 can only rotate about the axis of its spike 28. Such rotation of cap 20 has no adverse effect whatsoever on the extension of rod 16 from cap 22 and, by maintaining cap 20 precisely centered in its initial position, a level condition for assembly 10 can be maintained and marking or damage to wall 12 avoided.

Thus, once the rod 16 has been rotated to the extent necessary to firmly wedge assembly 10 in place, curtains or other articles can be hung from the assembly 10 without fear that the latter will pull loose from its mounted condition. The threaded relationship between rod 16 and cap 22 afforded by the coupling structure in the nature of component 24 and arbor 36 permits a very strong, pressure-mounted condition to be established for assembly 10 between walls 12 and 14 with incremental increases in the applied pressure being obtained without any possibility of retrograde loosening of the assembly 10. Moreover, in addition to the direct pressure relationship between caps 20, 22 and walls 12, 14, the pads 30 increase the friction between such structures so as to further resist dislodgment of assembly 10. Further, the presence of spikes 28 is beneficial in this regard.

Should a larger diameter rod be desired for use, such as rod 18, the installation procedure is carried out in precisely the same manner as with rod 16. In this situation, however, the larger diameter of the rod 18 causes the end disposed within cap 20 to seat against the tapered wall of cavity 32 at a point spaced from floor 34, as distinguished from the arrangement with rod 16. Further, the opposite end of rod 18 engages and tightens around component 24 at a point closer to the large end of the latter than rod 16. In either instance, however, the same tight, wedging fit of assembly 10 between walls 12 and 14 can be obtained, to the end that need for any and all fastening devices is completely eliminated.

Having thus described the invention, what is claimed as new and desired to be secured by Letters Patent is:

1. A self-mounting support rod assembly for disposition between a pair of opposed surfaces comprising:

an elongated, tubular member having a pair of opposed, open ends;

a pair of externally identical holding caps at opposite ends of said member having outermost faces on one side adapted to bear against said surfaces when the assembly is placed therebetween, said caps each having an internal cavity on the opposite side thereof in axial alignment with the corresponding end of said member and receiving the same, each cavity being provided with a floor and a continuous wall extending between said floor and said opposite side of its cap;

an internal, externally threaded arbor in the cavity of one of said caps projecting outwardly from its floor in coaxial relationship with said member and extending beyond said opposite side of the one cap, said arbor being of reduced diameter relative to its cavity to define an annular region between the arbor and the wall of the cavity extending from its floor outwardly to said opposite side of the one cap; and an internal, annular adapter component securely received within the end of said member associated with said one cap for rotation of the component with said member when the latter is rotated, said component being internally threaded and being mounted on said arbor for movement along the length of the latter when said member is rotated relative to said one cap to shift the end of said member along the length of the arbor within said region thereby extending or retracting the assembly, said face of each cap being provided with a resilient friction pad and being further provided with a single, outwardly projecting spike disposed in coaxial relationship with said member, said spike protruding beyond said pad.

2. An assembly as claimed in claim 1 wherein each of said caps is generally frustoconical, tapering away from said face.

* * * * *